US006247432B1

(12) United States Patent
Pischinger et al.

(10) Patent No.: US 6,247,432 B1
(45) Date of Patent: Jun. 19, 2001

(54) ENGINE VALVE ASSEMBLY FOR AN INTERNAL-COMBUSTION ENGINE, INCLUDING AN ELECTROMAGNETIC ACTUATOR

(75) Inventors: Martin Pischinger; Hans Kemper, both of Aachen; Günter Rudolf Feyerl, Alsdorf, all of (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/539,437

(22) Filed: Mar. 30, 2000

(30) Foreign Application Priority Data

Mar. 31, 1999 (DE) ..... 199 14 692
Aug. 12, 1999 (DE) ..... 199 38 297

(51) Int. Cl.[7] ..... F01L 9/04

(52) U.S. Cl. ..... 123/90.11; 123/90.65; 251/129.01; 251/129.16

(58) Field of Search ..... 123/90.11, 90.65; 251/129.01, 129.15, 129.16

(56) References Cited

U.S. PATENT DOCUMENTS 4,682,574 * 7/1987 Kreuter et al. ..... 123/90.11
5,199,392 * 4/1993 Kreuter et al. ..... 123/90.11
5,711,259 * 1/1998 Pischinger et al. ..... 123/90.11
6,003,481 * 12/1999 Pischinger et al. ..... 123/90.11
6,167,852 * 1/2001 Kamimaru et al. ..... 123/90.11

* cited by examiner

*Primary Examiner*—Weilun Lo
(74) *Attorney, Agent, or Firm*—Venable; Gabor J. Kelemen

(57) ABSTRACT

An engine valve assembly for an internal-combustion engine includes an engine valve having open and closed positions and a first oscillating mass; a closing spring connected to the valve for urging it into its closed position. The assembly has an electromagnetic actuator which operates the valve and which includes a first and a second electromagnet having respective first and second pole faces oriented toward one another and defining a space therebetween; an armature movable back and forth in the space between the first and second pole faces; and a guide bar affixed to the armature. The guide bar has an end oriented toward the valve and defining therewith a valve clearance when the valve is in its closed position and the armature is in contact with one of the electromagnets. The armature and the guide bar together have a second oscillating mass which is at least twice the first oscillating mass. The assembly further has an opening spring connected to the guide bar for urging the armature and the guide bar toward the valve.

5 Claims, 5 Drawing Sheets

ENGINE VALVE ASSEMBLY FOR AN INTERNAL-COMBUSTION ENGINE, INCLUDING AN ELECTROMAGNETIC ACTUATOR

CROSS REFERENCE TO RELATED APPLICATION

This application claims the priority of German Application Nos. 199 14 692.6 filed Mar. 31, 1999 and 199 38 297.2 filed Aug. 12, 1999, which are incorporated herein by reference.

BACKGROUND OF THE INVENTION

In current internal-combustion engines electromagnetic actuators have been used for operating engine valves, as disclosed, for example, in German Offenlegungsschrift (application published without examination) 195 18 056 to which corresponds U.S. Pat. No. 5,818,680.

An electromagnetically operated engine valve assembly for a piston-type internal-combustion engine essentially is formed of a valve body connected with a closing spring and an electromagnetic actuator which includes two electromagnets whose spaced pole faces are oriented towards one another and which includes an armature which may be reciprocated in the space between the pole faces of the two electromagnets. The armature is provided with a guide bar, one end of which is coupled with the valve stem and its other end is connected with an opening spring. Between the guide bar and the valve stem a valve clearance is provided.

A valve assembly of the above-outlined type constitutes an oscillatable spring/mass system whose total "mass" is formed essentially by the armature, its guide bar and the valve body whereas the "spring" is formed by the opening and closing springs. The assembly is conventionally designed in such a manner that both resetting springs are of identical configuration.

According to the basic principle of such engine valve assemblies, for reducing the electrical energy required for the operation, the natural oscillating capacity of the spring/mass system is utilized so that in principle the momentary capturing magnet and the holding magnet which retains the valve during the determined open and closed periods has to be supplied only with a limited current. The current intensity is such that the armature, as it passes its mid position, begins to be attracted by the capturing electromagnet, otherwise the kinetic energy of the total mass is utilized for a significant part of the motion.

As the armature approaches the pole face of the energized capturing electromagnet, the spring force of the oppositely acting resetting spring increases only linearly while in case of a constant current supply of the capturing electromagnet the magnetic forces derived therefrom and acting on the approaching armature increase exponentially. Since for ensuring a reliable capture of the armature, the electromagnetic force has to overcome the oppositely oriented increasing spring force, a number of methods have been developed for regulating the current supply. Such a regulation has the purpose of decreasing the current supply during the approach of the armature to the pole face of the capturing electromagnet. Such a reduction in the current supply reduces the magnetic force acting on the armature for ensuring a soft arrival of the armature on the pole face to thus avoid disadvantageous rebounding phenomena.

For regulating the current supply of the momentarily capturing electromagnet, it is necessary to detect the momentary position of the armature relative to the pole face and/or the velocity of the armature in the zone of approach. For this purpose methods have been developed which detect the feedback effects of the armature, as it moves through the magnetic field, on the supply current and voltage to derive therefrom the necessary signals for affecting the current supply.

In addition, regulating systems have been developed in which the momentary armature position and/or the momentary armature velocity is detected by sensors directly at the armature. Since for structural reasons alone the armature, together with its guide bar, and the valve body which is formed essentially of the valve head and valve stem cannot be made of a single piece, a clearance is necessarily present between the free end of the valve stem, on the one hand, and the adjoining end of the guide bar, on the other hand. The clearance, because of the varying temperature effects, changes during the operation of the internal-combustion engine.

In conventional hydraulic valve slack adjusting arrangements positioned between the guide bar and the valve stem an oil-chargeable cylinder has been used for bridging the valve clearance like a "rigid" intermediate layer, while compensating for any change in the valve clearance. Such valve slack adjusting systems are expensive to manufacture. Considering the possibilities of a fully variable electromagnetic valve drive, it is a desideratum to permit a valve clearance to make possible an avoidance of valve motion problems by suitably controlling the current supply. For such a control the detection of the armature motion and/or the armature velocity during the first phase of motion is of significance. Advantageously, signals are derived directly from the detection of the respective armature position and armature velocity.

By virtue of the presence of a valve clearance the oscillatable spring/mass system formed by the entire arrangement is divided into two partial systems which are timewise uncoupled. As a result, particularly at the beginning of the valve opening process, but also at the end of the valve closing process, the armature supported by the opening spring, together with its guide bar, may execute displacements relative to the valve body supported by the closing spring. As the guide bar of the armature strikes the valve stem, the spring/mass system formed by the two resetting springs and the masses of the armature and the valve is forced into a resonance oscillation which is quieted only when the armature arrives into contact with the opening magnet. The oscillating motion of the armature which is derived from the resonance oscillation and which is superposed on the armature travel makes even more difficult to guide the armature to the pole face of the capturing opening magnet with a possibly low impact velocity. Thus, despite a controlled guidance of the armature motion by a suitable control of the capturing current, disadvantageous rebound phenomena cannot be avoided.

For eliminating the above-noted rebound phenomena, according to U.S. Pat. No. 5,832,883 the armature is fixedly coupled with the valve body and a hydraulic dampening element is provided which is fixedly attached to the valve and by means of which the seating velocity of the valve is to be reduced. In this arrangement a valve clearance is not provided. This known system cannot be driven by utilizing the natural oscillation because of the continuously present dampening effect during the entire valve motion. The purpose of such dampening is to ensure a soft arrival of the valve into its valve seat. In such a construction the armature, in the seated position of the valve, may not come in contact with the pole face and further, for equalizing the braking effect of the dampening, element, the closing spring must be stronger than the opening spring. This results in a higher energy requirement, one reason being that the dampening element does not have a useful natural oscillation capability.

Disadvantageously, in seeking to reduce the total mass of the oscillatable system, only a reduction of the armature mass has been attempted on the grounds that a reduction of the valve body mass is very limited in view of the required valve material. After shutting off the holding current of the closing magnet, because of the high acceleration caused by the opening spring, the armature, as it strikes the valve stem, introduces a high energy boost into the partial system formed by the closing spring and the valve body even in case of a small valve clearance of 0.1 mm. As a result of such an energy boost, the armature executes, against the force of the opening spring, multiple oscillations which are superposed on the opening motion and further, at the same time, the valve body too, which moves in the opening direction, executes an oscillation superposed on the opening motion. Based on the multiple, out-of-phase, and oppositely oriented motions of the armature and the valve body, on both moving systems an oscillating motion is superposed which continues substantially beyond the mid position of the armature between the two pole faces.

If by means of a suitable sensor system the position of the armature and/or the armature velocity is detected directly at the armature, only a "washed-out" or "noisy" signal rather than an accurate signal can be obtained because of the oscillating motion of the armature.

SUMMARY OF THE INVENTION

It is an object of the invention to provide an improved electromagnetic actuator of the above-outlined type from which the discussed disadvantages are eliminated.

This object and others to become apparent as the specification progresses, are accomplished by the invention, according to which, briefly stated, the engine valve assembly for an internal-combustion engine includes an engine valve having open and closed positions and a first oscillating mass; a closing spring connected to the valve for urging it into its closed position. The assembly has an electromagnetic actuator which operates the valve and which includes a first and a second electromagnet having respective first and second pole faces oriented toward one another and defining a space therebetween; an armature movable back and forth in the space between the first and second pole faces; and a guide bar affixed to the armature. The guide bar has an end oriented toward the valve and defining therewith a valve clearance when the valve is in its closed position and the armature is in contact with one of the electromagnets. The armature and the guide bar together have a second oscillating mass which is at least twice the first oscillating mass. The assembly further has an opening spring connected to the guide bar for urging the armature and the guide bar toward the valve.

Within the context of the invention the mass of the armature is defined as the mass of the armature plate itself, together with the guide bar affixed to the armature as well as the reduced mass of the opening spring and the mass of the spring seat pin associated with the opening spring. Although the spring seat pin is not coupled fixedly with the armature guide bar, it was found that during operation, because of the geometric association between the opening spring, the spring pin and the armature with the armature guide bar the armature during the oscillating motions does not develop an "own life" with respect to the spring seat pin.

The mass of the valve (also termed as valve body) is defined as the mass of the valve body itself, including the valve head, the valve stem and the valve spring disk as well as the reduced mass of the closing spring.

By increasing the armature mass relative to the mass of the valve body, the armature motion is stabilized as it strikes the valve stem during the opening motion, and, as a result, the natural oscillations of the armature attenuate much faster. In this arrangement it is not a disadvantage that the natural oscillations of the valve body which, because of the relatively smaller mass of the valve body are superposed in a reinforced manner to the opening motion, are somewhat large at the moment of impact. This is so because these natural oscillations attenuate much faster due to the stabilizing effect of the armature mass and the dampening forces affecting the valve attenuate much sooner so that the entire system comes to a rest at a much earlier moment. It is, however, of significance that the natural oscillations of the armature are rapidly quieted after the impact of the armature guide bar on the valve stem so that a "noise suppression" for the signal representing the armature motion is obtained.

Beyond the above-determined minimum relationship between the armature mass and the valve mass a selection of the actual relationship may be made within a wide range. In case it is desired to obtain a signal via the rebound phenomenon immediately when the guide bar of the armature strikes the valve stem, it is expedient to increase the ratio of the armature mass relative to the valve body mass only to such an extent that the sensor system is just able to detect a meaningful signal. It is, nevertheless, a disadvantage that the overlapping oscillations are quieted at a later moment as concerns both the armature motion and the valve body motion. In case such a signal is not needed, then by virtue of a further increase of the armature mass the natural oscillation of the armature mass caused by the impacting may be minimized.

To avoid an increase of the energy consumption particularly upon starting the oscillation which is essential for the operation, a reduction of the entire oscillating mass is indicated. Such a reduction would be possible by using a different, lighter material for the valve body, such as a ceramic. This, however, also renders possible a reduction of the armature mass if the criteria provided by the invention are observed as concerns the division between the armature mass and the valve body mass in order to at least minimize the natural oscillations of the armature mass caused during the opening process by the impacting of the armature guide bar on the valve stem. A reduction of the entire mass of the oscillatable spring/mass system established by the valve drive then allows an adaptation of the spring constants of the springs to the operational conditions of the internal-combustion engine. In this connection an increase of the spring constants by 0.15 mm has been found to be advantageous in case of the usual valve clearances.

It is further advantage of the invention that a valve slack adjuster may be dispensed with because a noise generation is also reduced by means of a shortening of the rebound phenomena and the natural oscillations of armature and valve body during the opening motion and a reduction of the amplitudes of the natural oscillations of armature and valve body.

For reducing the natural oscillations of the system in an engine valve arrangement of the above-outlined type, particularly in conjunction with the minimum armature/valve mass ratio set according to the invention, the two resetting springs of the electromagnetic actuator have unlike spring characteristics. By means of such an "asymmetrical" spring arrangement the given spring/mass system is "out-of-tune" and thus no definite resonance frequency exists. As a result, the excitation for oscillation caused by the impact of the armature mass on the engine valve after bridging the valve clearance attenuates rapidly and the armature impacts on the pole face of the capturing opening magnet practically without oscillation.

DESCRIPTION OF THE PREFERRED EMBODIMENTS

Figure 1:
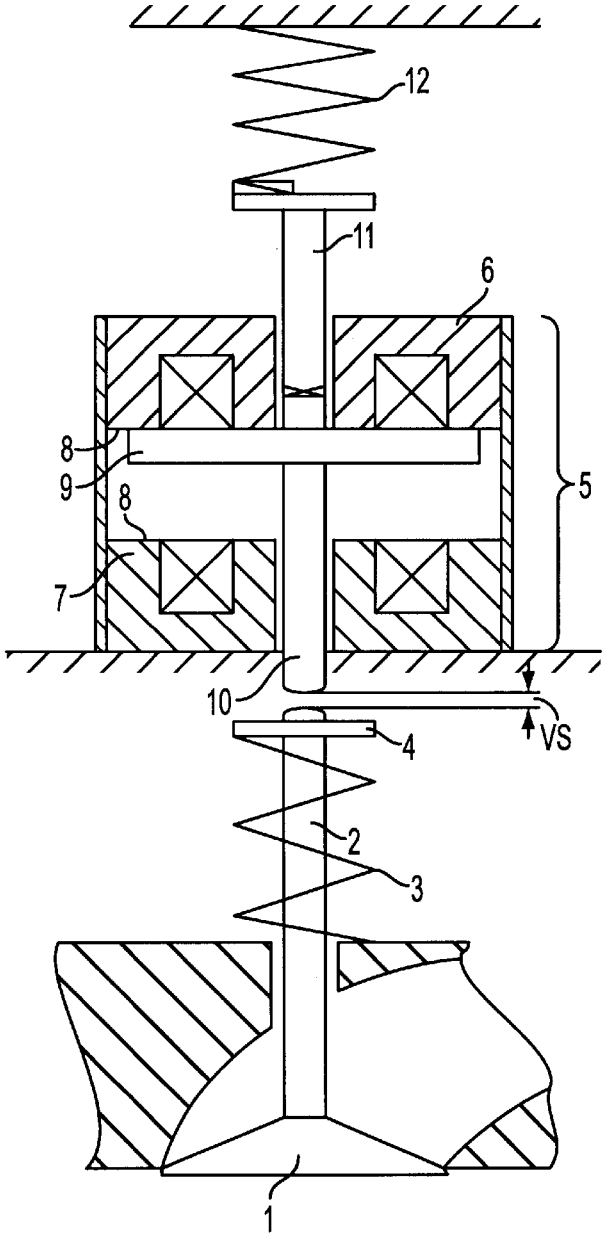
FIG. 1 is a schematic axial sectional view of an electromagnetically operated engine valve assembly incorporating the invention.

Turning to FIG. 1, the engine valve assembly of an internal-combustion engine shown therein and to be examined as the specification progresses, includes a valve body 1 having a valve stem 2 which is coupled with a closing spring 3 and which is maintained in the closed position by the force of the closing spring 3 exerted on the valve by means of a valve seat disk 4 affixed to the valve stem 2 and also forming part of the valve body 1.

For operating the engine valve an electromagnetic actuator 5 is provided which essentially is composed of an opening magnet 7 and a closing magnet 6, whose pole faces 8 are spaced and are facing one another. An armature 9 is disposed for reciprocation in the space between the two pole faces 8. The armature 9 is firmly affixed to an armature guide bar 10 and is supported by an opening spring 12 with the interposition of a spring seat pin 11.

In FIG. 1 the entire system is shown in its closed position, that is, the armature 9 is in engagement with the pole face 8 of the closing magnet 6, and the opening spring 12 is compressed to a certain extent. Further, the valve body 1 is maintained in its closed position by the closing spring 3. Between the end of the armature bar 10 and the end of the valve stem 2 a valve clearance VS of about 0.15 mm is provided. Thermal effects may change the valve clearance VS within certain limits. During operation such thermal effects cause length changes particularly of the valve stem 2 and/or similarly oriented length changes of the cylinder head carrying the electromagnetic actuator 5.

If the engine valve 1 is to be opened, the closing magnet 6 is de-energized, whereupon the armature 9 is accelerated by the opening spring 12 in the direction of the engine valve 1 and, after bridging the valve clearance VS, the guide bar 10 strikes the end of the valve stem 2 and pushes forward the valve body 1 into the opening direction. The opening magnet 7 is energized by the engine control during the armature motion so that the armature 9, as it passes its mid position, enters into the effective range of the increasing magnetic field and then contacts, against the force of the closing spring 3, the pole face 8 of the opening magnet 7. At the end of the holding period determined by the engine control, the opening magnet 7 is de-energized and thus the armature 9 again moves back toward its closed position, it is captured by the closing magnet 6 and held until the successive valve opening step. The closing spring 3 and the opening spring 12 form the resetting springs for the armature 9.

If a valve slack adjuster is provided by means of which the valve clearance VS is bridged by a suitable hydraulic coupling, a practically synchronous movement of the armature and the valve body 1 occurs every time the holding magnet is de-energized. If, however, a valve clearance (play) is present, then during the opening step the armature 9 first moves alone, with its guide assembly formed by the armature guide bar 10 and the spring seat pin 11, under the effect of the accelerating force of the opening spring 12, until the guide bar 10 strikes the free end of the valve stem 2. Thereafter the total mass formed by the mass of the armature and the mass of the valve body continues to be displaced.

Figure 2:
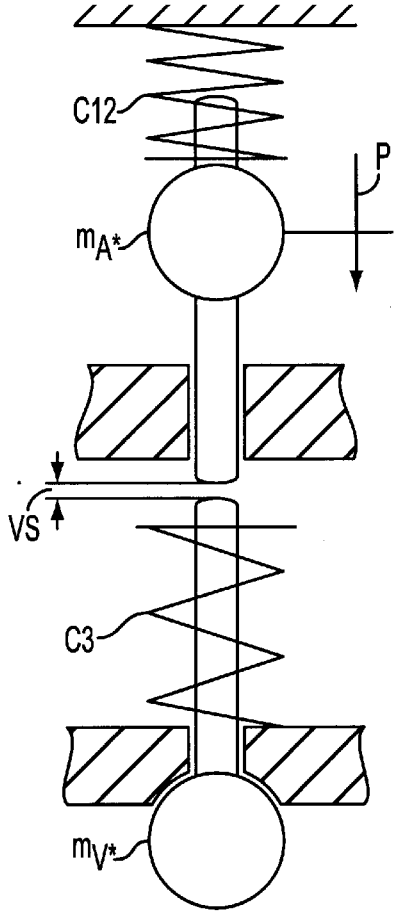
FIG. 2 is a diagram of the oscillating system derived from the structure illustrated in FIG. 1.

The mechanical system illustrated in FIG. 1 is to be separated into an oscillating system of springs and masses; such a separation is illustrated in FIG. 2. The armature mass $m_{A*}$ is formed by the mass of the armature 9 the guide bar 10 and the spring seat pin 11 and the "reduced" mass of the opening spring 12. In FIG. 2 the mass $m_{A*}$ is represented by a mass dot while the opening spring 12 is symbolized by its spring constant C12. The armature guide bar 10 is represented merely as a component which has no mass. Further, the oscillating valve mass $m_{v*}$ is represented as a mass dot and is formed by the mass of the valve body 1, the valve seat disk 4 and the reduced mass of the closing spring 3. The closing spring 3 is only schematically illustrated by its spring constant C3 while the valve stem 2 is shown as a structural element having no mass.

Figure 3:
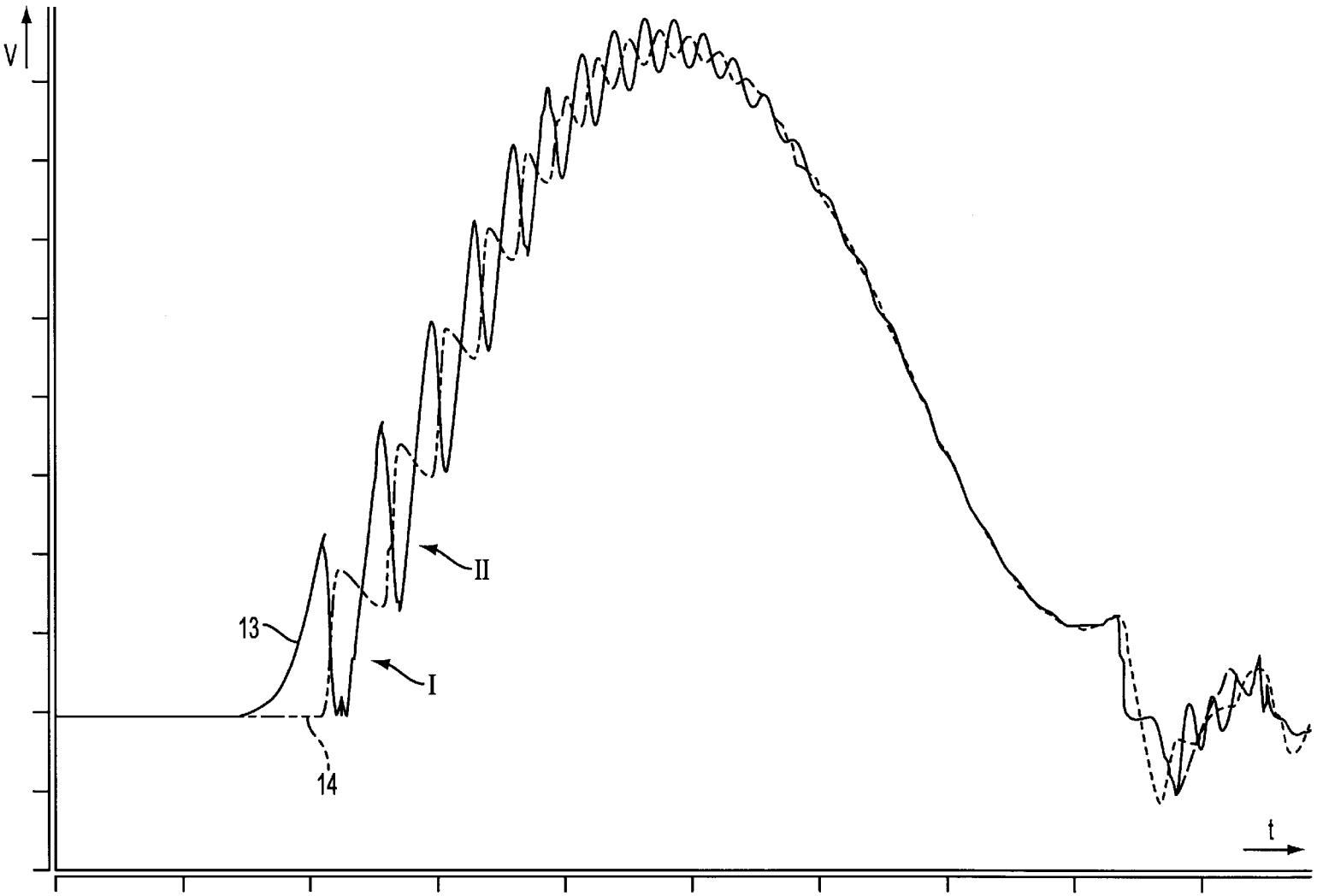
FIG. 3 is a graph illustrating the speed/time function for the armature and the valve body in case of a "small" armature mass.

As indicated by the force arrow P, the exciting force P is applied to the armature mass $m_{A*}$. The spring/mass system in FIG. 2 is shown in the closed position illustrated in FIG. 1. Examining the system shown in FIG. 2 at the same valve clearance VS and the same spring constants C3, C12, but with different mass ratios, then for a mass ratio $m_{A*}/m_{v*}=0.6$ the curve 13 for the armature mass $m_{A*}$ and the curve 14 for the valve mass $m_{v*}$ is obtained, as shown in FIG. 3. It will be recognized that the armature speed increases substantially from the moment the armature 9 separates from the pole face 8 of the holding closing magnet until the impact of the free end of the armature guide bar 10 on the end of the valve stem 2. Then, upon impact, the armature speed suddenly drops and swings back while the valve mass continues to move in the opening direction with a correspondingly increasing speed (position I). During this occurrence, the valve clearance again "opens" so that the armature mass $m_{A*}$ upon repeated reversal of motion under the influence of the opening spring 12, again strikes the valve mass $m_{v*}$ (position II) and is again braked, whereas the valve mass $m_{v*}$ is accelerated and swings back again in the direction of the pole face of the closing magnet 6. Since by virtue of these oppositely oriented oscillating motions the total system is subdivided into two partial systems C12-$m_{A*}$ and C3-$m_{v*}$, the partial system C3-$m_{v*}$ too, executes its own motion: after the first accelerations (position I) the mass $m_{v*}$ swings slightly backward and thereafter upon the repeated impacting of the armature mass $m_{A*}$ is driven further into the opening direction (position II) as it may be seen in the illustration according to FIG. 3.

It is seen in FIG. 3 that the overlapping and timewise oppositely oriented oscillations of the two partial masses $m_{A*}$ and $m_{v*}$ continue far beyond the peak location. In this connection it must not be ignored that the longitudinal elasticity of the armature guide bar 10 and the valve stem 2 also play a role. Thus, the extent of rebound may be reduced by selecting substantially non-elastic materials (such as ceramics) at least for the valve stem and possibly also for the armature guide bar 10.

Figure 4:
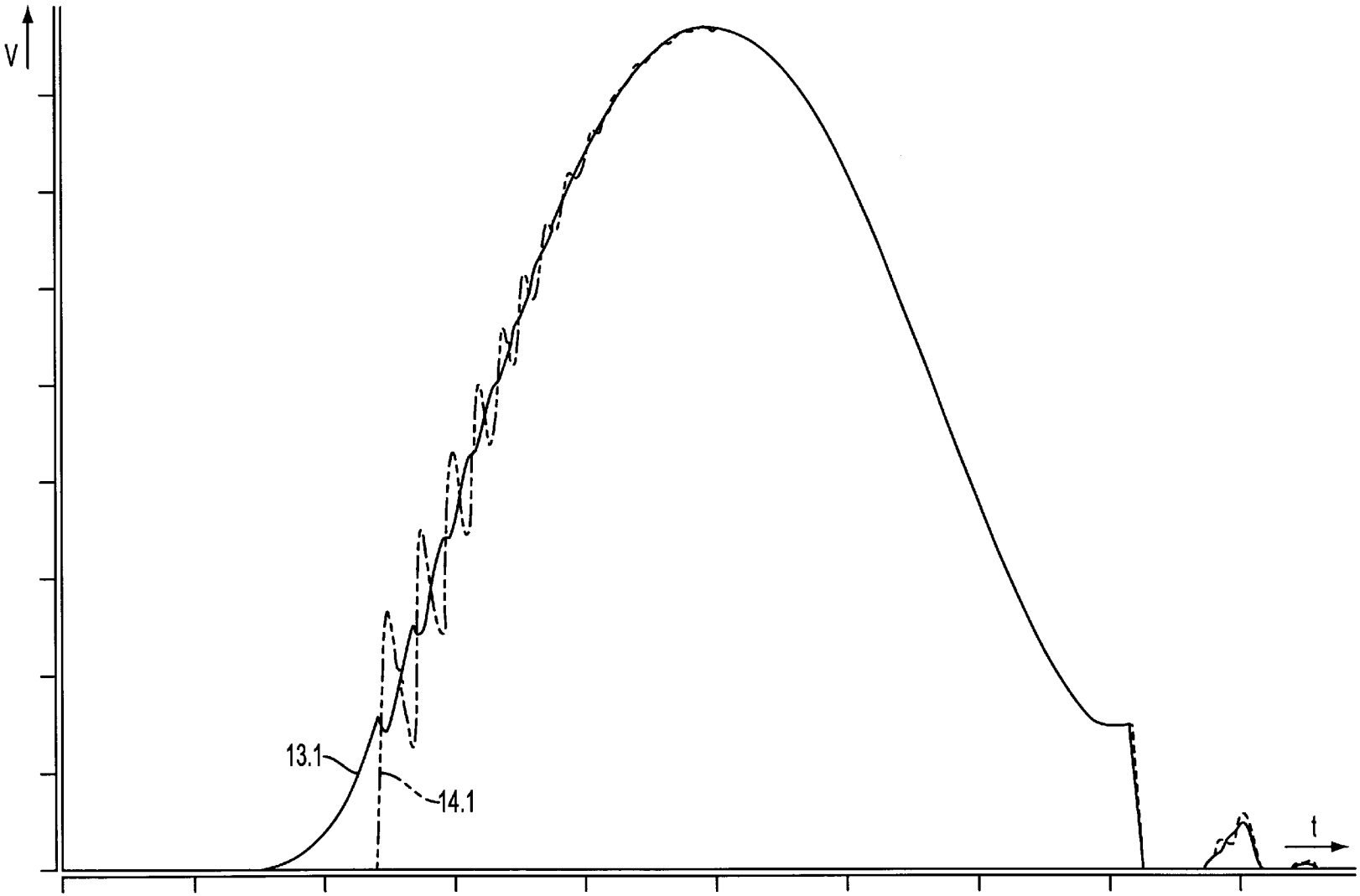
FIG. 4 is a graph illustrating the speed/time function for the armature and the valve body in case of a "large" armature mass.

To show the boundary region, the mass distribution was switched to the extreme while maintaining the total mass at the same magnitude. Thus, in the experiment illustrated in FIG. 4, the armature mass $m_{A*}$ has been significantly increased, while the valve mass $m_{v*}$ has been significantly reduced so that an approximate mass ratio $m_{A*}/m_{v*}=6$ was obtained which is ten times the mass ratio of the experiment according to FIG. 3. As a result, the larger armature mass $m_{A*}$ after bridging the valve clearance VS and upon striking the stem of the valve body 1 has only a slight speed loss as it may be seen in curve 13.1, while the lighter valve body executes significantly greater natural oscillations. It is be recognized, however, that because of the "quieting" by virtue of the larger armature mass $m_{A*}$, the valve mass $m_{v*}$ also comes to rest much sooner. The cause therefor is, last but not least, also seen in the greater dampening which, in turn, is caused by the higher friction and braking effects of the gas flow on the valve body.

Figure 5:
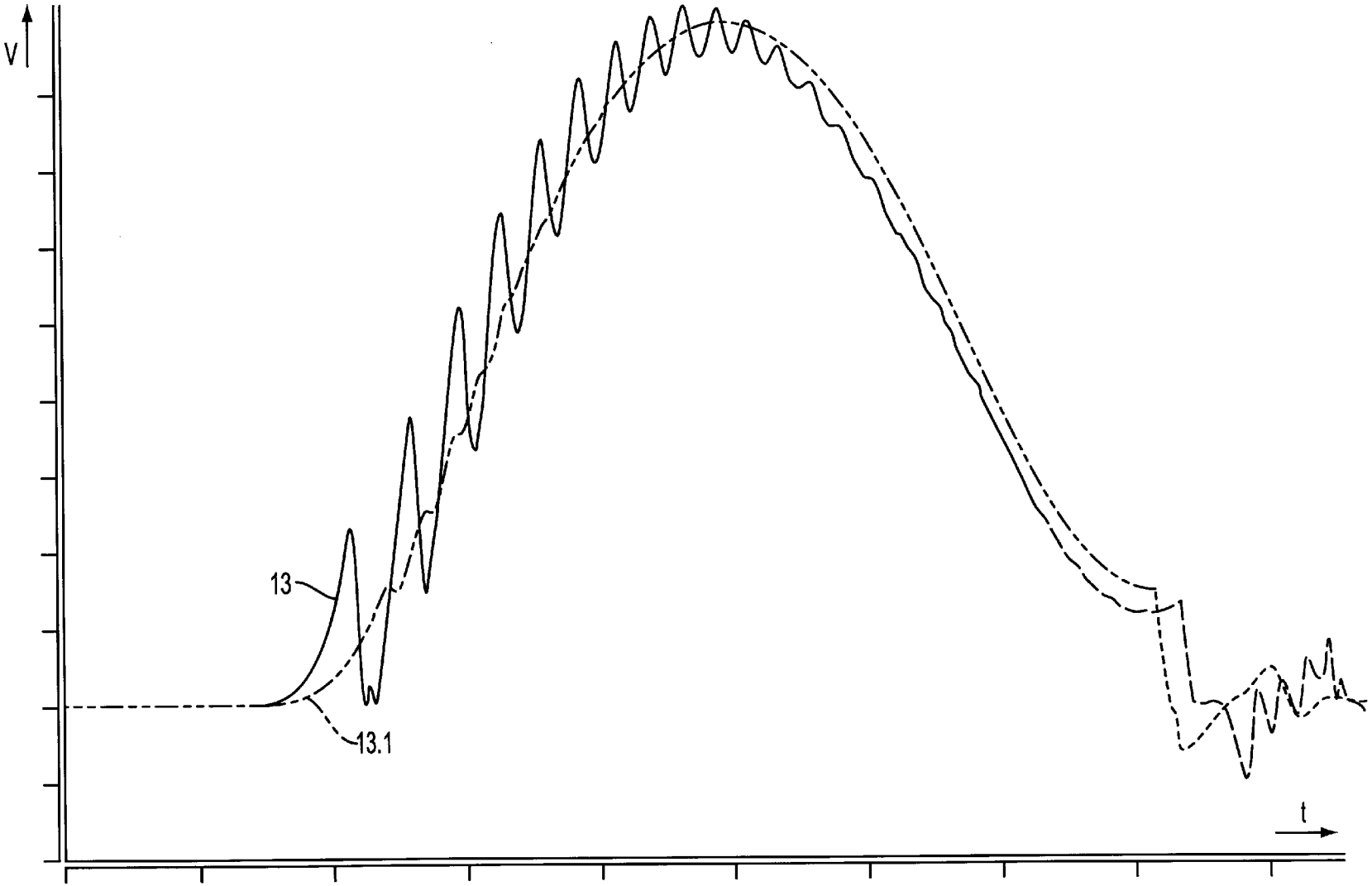
FIG. 5 is a graph illustrating the superposition of the curves of armature motions in case of designs according to FIGS. 3 and 4.

In FIG. 5 the curves 13 and 13.1 for the armature speed for the two experiments are superposed. It may be clearly recognized that by means of a corresponding increase of the mass ratio $m_{A*}/m_{V*}$ the motions of the armature mass itself may be reduced, and, dependent on the resolution capacity of the used sensors, for the detection of the armature motion it is not necessary to increase the mass ratio $m_{A*}/m_{V*}$ to an extreme extent.

If it is desired to also detect the impacting of the armature 9 on the valve stem 2 by the detection of the armature motion, the ratio $m_{A*}/m_{V*}$ must be changed by enlarging the armature mass only to such an extent that at the given sensitivity of the sensor system the moment of impact can still just be detected from the armature motion, that is, the mass ratio must be deliberately so changed that a detectable first rebound of the armature mass $m_{A*}$ occurs.

Figure 6:
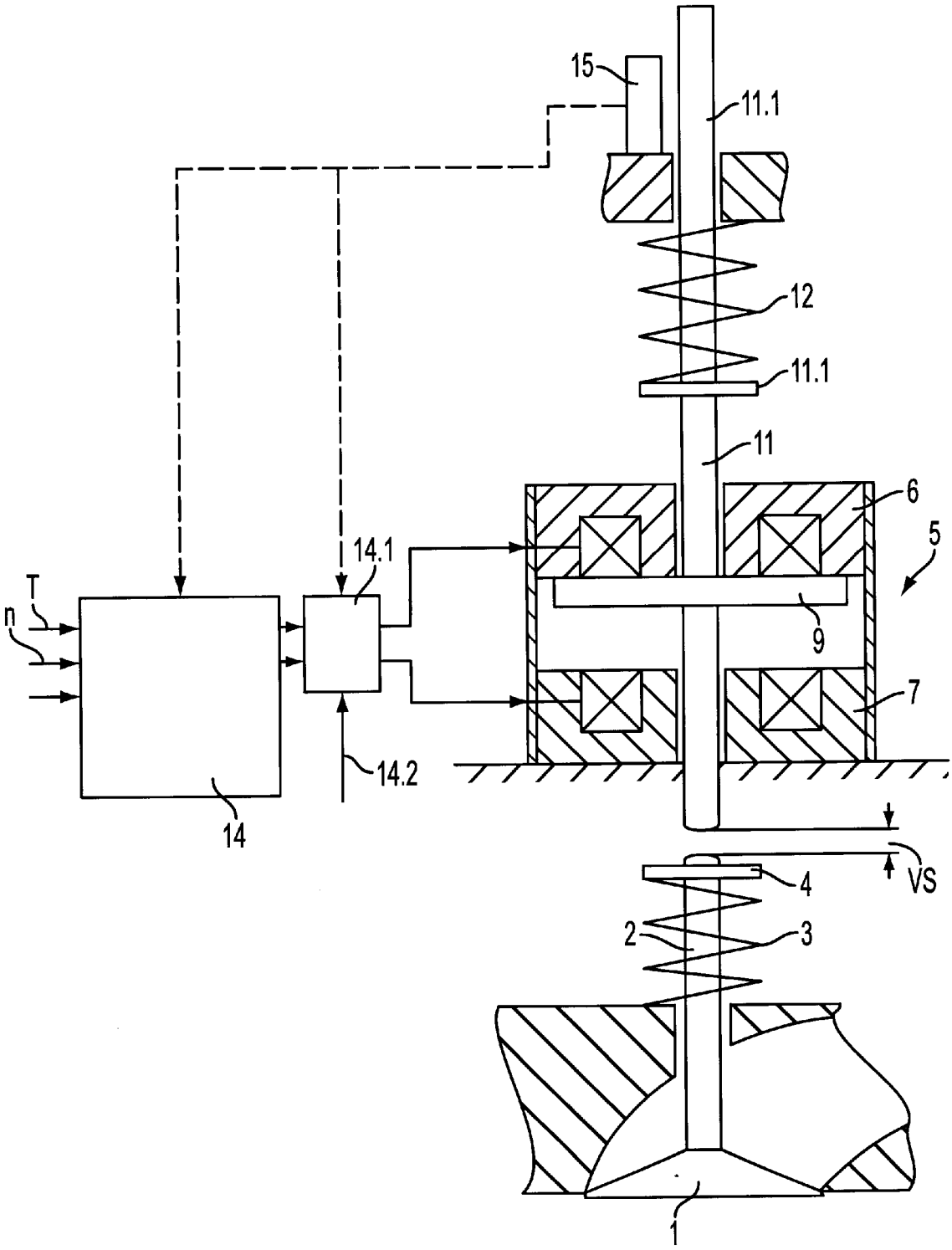
FIG. 6 is a schematic axial sectional view of an electromagnetically operated engine valve assembly having "asymmetrical" resetting springs.

An embodiment having an "asymmetrical" spring assembly will be discussed below in more detail in conjunction with a schematic showing in FIG. 6.

The modified electromagnetic actuator for operating an engine valve 2 is composed, similarly to FIG. 1, essentially of a closing magnet 6 and an opening magnet 7 which are spaced from one another and between which an armature 9 is reciprocated against the force of a resetting opening spring 12 and a resetting closing spring 3. The valve assembly is shown in the drawing in its closed position. In the illustrated "classical" arrangement, the closing spring 3 acts directly on the valve via a spring seat disk 4 affixed to the valve stem. The armature guide bar 10 of the electromagnetic actuator is separated from the valve stem and, as a rule, a valve clearance VS is present in the closed position. The opening spring 12 is supported by a spring seat disk 11.1 on the spring seat pin 11 so that during the opening motion the spring seat pin 11 is in contact with the stem of the engine valve as the opening spring 12 and the closing spring 3 exert oppositely oriented forces on the valve stem.

The alternating energization of the electromagnets 6 and 7 of the actuator is effected by means of a current regulator 14.1 which, in turn, is controlled by an electronic control unit 14 of the engine in accordance with predetermined control programs and as a function of operational data, such as rpm, temperature, etc. applied to the control unit 14. As a result, the engine valve is moved in a controlled manner into its open and closed positions. While it is in principle possible to provide for all actuators of an internal-combustion engine a central current regulator, it may be expedient to associate each actuator with its own current regulator which is connected with a central voltage supply 14.2 and controlled by the engine control unit 14.

A sensor 15 is positioned adjacent a moving actuator component (such as the spring seat pin 11.1) for detecting actuator functions and applying signals to the control unit 14 and the current regulator 14.1. Dependent on the design of the sensor, for example, the path traveled by the armature 9 may be detected so that signal representing the momentary armature positions may be applied to the engine control unit 14 and/or the current regulator 14.1. In the engine control unit 14 or the current regulator 14.1 the armature speed may be determined by means of suitable computer operations, so that as a function of the armature position and/or the armature speed, the current supply of the two electromagnets 6 and 7 may be controlled.

If after de-energization of the holding (closing) magnet 6 the armature 9 is moved in the direction of the engine valve 1 by the force of the opening spring 12, the mass composed of the armature 9 and the components 10, 11 first bridges the valve clearance VS and then impacts on the valve stem 2 of the still closed engine valve 1. Thereafter the engine valve 1 is opened by the force of the opening spring 12 and the starting effect of the magnetic force of the opening magnet 7. By means of the impact the spring/mass system formed of the two resetting springs 3 and 12 as well as the armature 9, the guide bars 10, 11 and the engine valve 1 are excited to start a resonance oscillation which is superposed on the opening motion.

In order to suppress such a resonance oscillation, unlike spring characteristics for the opening spring 12 and the closing spring 3 are chosen, while maintaining the structure otherwise unchanged. In the embodiment illustrated in FIG. 6 the closing spring 3 is, for example, "harder", that is, it has a higher spring characteristic than the opening spring 12. By this measure the spring/mass system is placed "out of tune" so that based on the impacting by the armature mass after overcoming the valve clearance VS the oscillations superposed on the opening motion are practically entirely quieted during the opening motion since the system is deprived of the possibility of oscillation in the natural frequency due to the unlike design of the springs. In the drawing the unlike spring characteristics of the two resetting springs 3 and 12 are symbolically indicated by different spring thicknesses.

It is expedient to design the closing spring 3 to have the higher spring characteristic, that is, to be harder in order to ensure a reliable closing of the engine valve.

The principle of the "out of tune" setting of the two resetting springs 3 and 12 may also be utilized in a structure where the armature mass/valve body mass is normal. It is, however, advantageous to combine the unlike spring characteristics with the armature mass/valve body mass ratio set in accordance with the invention.

It will be understood that the above description of the present invention is susceptible to various modifications, changes and adaptations, and the same are intended to be comprehended within the meaning and range of equivalents of the appended claims.

What is claimed is:

1. An engine valve assembly for an internal-combustion engine, comprising (a) an engine valve having open and closed positions and a first oscillating mass;

(b) a closing spring connected to said valve and urging said valve into said closed position;

(c) an electromagnetic actuator operating said valve and including (1) a first and a second electromagnet having a first and second pole face, respectively; said first and second pole faces being oriented toward one another and defining a space therebetween;

(2) an armature movable back and forth in said space between said first and second pole faces; and (3) a guide bar affixed to said armature; said guide bar having an end oriented toward said valve and defining therewith a valve clearance when said valve is in said closed position and said armature is in contact with one of said first and second electromagnets; said armature and said guide bar together having a second oscillating mass; said second oscillating mass being at least twice said first oscillating mass; and (d) an opening spring connected to said guide bar and urging said armature and said guide bar toward said valve.

2. The engine valve assembly as defined in claim 1, wherein said opening spring and said closing spring have identical masses and spring constants.

3. The engine valve assembly as defined in claim 1, wherein an upper limit by which said second oscillating mass exceeds said first oscillating mass is set such that during a motion of said armature for placing said valve into said open position, a first impacting of said guide bar on said valve is still detectable as a speed drop.

4. The engine valve assembly as defined in claim 1, wherein said opening spring and said closing spring have different spring characteristics.

5. Engine valve assembly for an internal-combustion engine, comprising (a) an engine valve having open and closed positions;

(b) a closing spring connected to said valve and urging said valve into said closed position; said closing spring having first spring characteristics;

(c) an electromagnetic actuator operating said valve and including (1) a first and a second electromagnet having a first and second pole face, respectively; said first and second pole faces being oriented toward one another and defining a space therebetween;

(2) an armature movable back and forth in said space between said first and second pole faces; and (3) a guide bar affixed to said armature; said guide bar having an end oriented toward said valve and defining therewith a valve clearance when said valve is in said closed position and said armature is in contact with one of said first and second electromagnets; and (d) an opening spring connected to said guide bar and urging said armature and said guide bar toward said valve; said opening spring having second spring characteristics being different from said first spring characteristics.

* * * * *